United States Patent [19]

Allen et al.

[11] Patent Number: 4,979,668

[45] Date of Patent: Dec. 25, 1990

[54] LEAK-PROOF CLOSURE FOR CARDBOARD CONTAINER

[76] Inventors: Kent N. Allen, #Mallard Dr., Belvedere, Calif. 94920; Raymond D. Coleman, 580 Fernando Dr., Novato, Calif. 94945

[21] Appl. No.: 464,378

[22] Filed: Jan. 12, 1990

[51] Int. Cl.[5] ..... B65D 45/04

[52] U.S. Cl. ..... 229/125.39; 229/125.12; 383/69

[58] Field of Search ..... 229/125.12, 125.13, 229/125.39; 383/69; 206/621.1, 621.2, 631.3; 24/30.5 R, 30.5 L

[56] References Cited

U.S. PATENT DOCUMENTS

| | | | |
|---|---|---|---|
| 1,371,934 | 3/1921 | Reynolds | 383/69 |
| 1,961,382 | 6/1934 | Nunes | 383/69 |
| 2,030,134 | 2/1936 | Burgener | 229/125.12 |
| 2,179,231 | 11/1939 | Moore | 229/125.12 |
| 3,217,967 | 11/1965 | Jackson | 206/631.3 |
| 3,458,110 | 7/1969 | Goldman | 229/125.12 |
| 3,463,380 | 8/1969 | Cooperstein | 206/631.3 |
| 3,659,776 | 5/1972 | Suominen | 24/30.5 L |
| 3,693,864 | 9/1972 | Wilkins | 229/125.12 |
| 4,109,351 | 8/1978 | Coffey | 24/30.5 R |
| 4,541,117 | 9/1985 | Ashbeck | 383/69 |

FOREIGN PATENT DOCUMENTS

| | | | |
|---|---|---|---|
| 897124 | 4/1972 | Canada | 229/125.39 |
| 954212 | 12/1949 | France | 383/69 |

*Primary Examiner*—Gary E. Elkins

*Attorney, Agent, or Firm*—Owen, Wickersham & Erickson

[57] ABSTRACT

A reclosure device adapted for installation on a cardboard container having side walls and end walls that fold together at the upper end of the container to allow the upper edges of the side walls to be positioned adjacent each other. An elongated track member having spaced apart side portions adapted for attachment to the adjacent upper edges of the container side walls, each side portion having a guide members extending along its outer surface and substantially the full width of the carton side walls. An elongated slider member attached to the track member parallel to the guide members has opposed jaw portions along its length with edge portions which are slidable on the guide members. Stop members are provided at opposite ends of the guide members for retaining the slider on the track member.

6 Claims, 2 Drawing Sheets

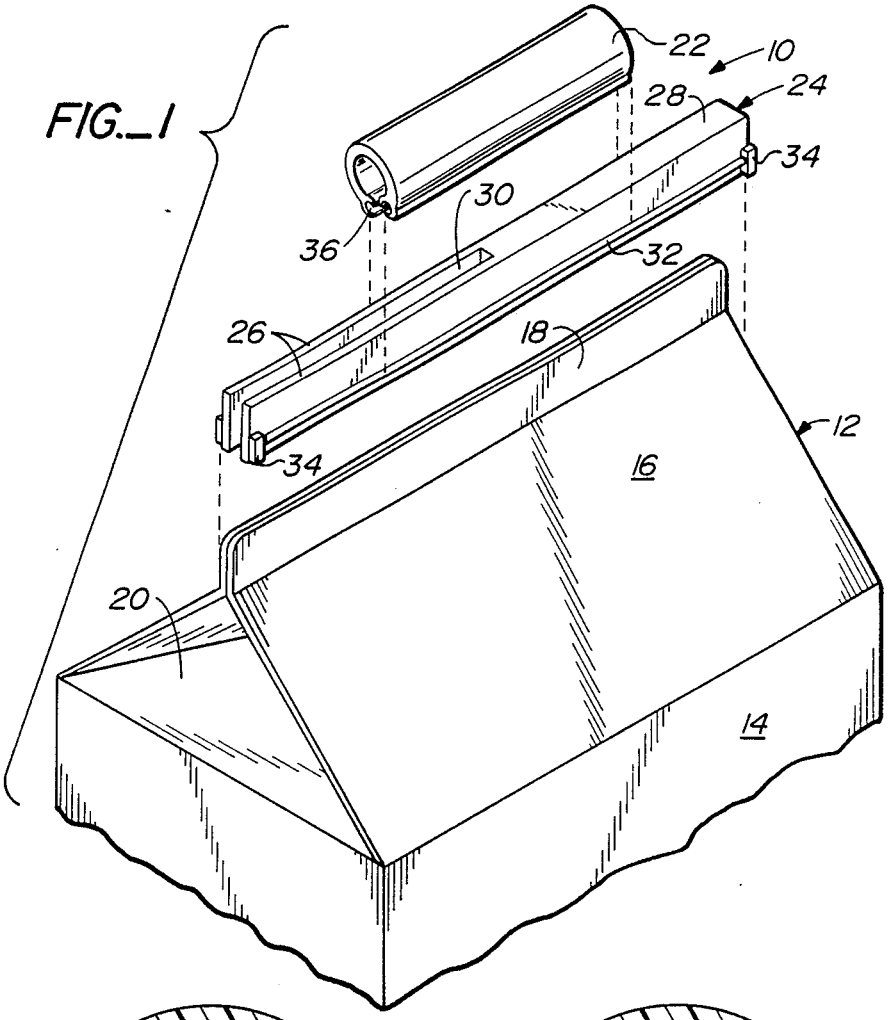
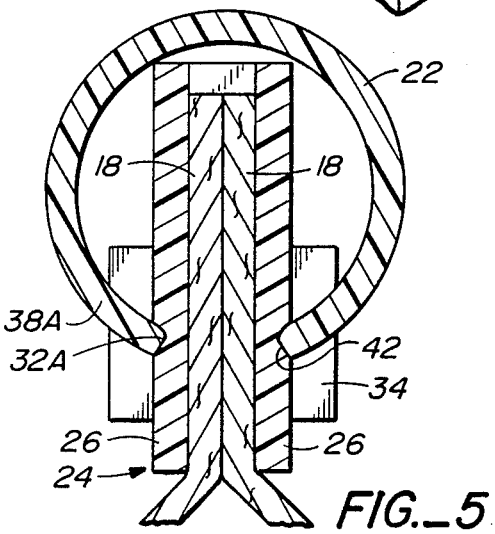
FIG._5
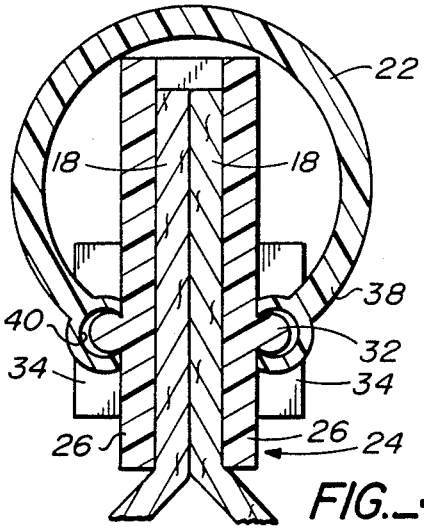
FIG._4

LEAK-PROOF CLOSURE FOR CARDBOARD CONTAINER

This invention relates to an improved closure device for foldable containers such as milk cartons and the like.

Background of the Invention

Foldable liquid containers such as cardboard cartons for milk and other products have long been in use. Such cartons are normally opened at their upper end by separating a pair of previously glued and folded carton panel sections. If only a portion of the liquid in the carton is used after being opened initially, the open panel sections are folded back to their original position before the carton is stored until used later. Merely folding back the initially glued portions of the carton does not seal it. Often it is highly desireable to seal the carton tightly to prevent contamination from environmental odors in a storage unit. Also, if the carton was overturned after its initial opening, leakage would occur. The problem of resealing a previously opened milk carton has been recognized by others as seen in U.S. Pat. Nos. 2,336,503 and 3,458,110. However, these prior disclosures failed to provide a reliable and practical reclosure assembly.

It is therefore one object of the present invention to provide a locking reclosure for a cardboard carton that is reliably leak-proof and enables the carton to be opened and closed many times before its contents are consumed.

Another object of the present invention is to provide a reclosure assembly for a folding carton that can be easily attached thereto.

Yet another object of the invention is to provide a carton closure that is easy to operate with a minimum of sliding friction and yet will maintain the carton leak-proof even if it is turned upside down.

Still another object of this invention is to provide a carton closure assembly that is particularly adaptable for ease and economy of manufacture.

Summary of the Invention

In accordance with the principles of the invention a closure device for foldable cardboard containers is provided which comprises an elongated track a guide member and a movable slider mounted on the track member. The latter has generally a channel shaped cross-section for approximately one half of its length and is adapted to fit over the top edge portions of adjoining side panels on the carton. On each outer side of the track member is a guide means which extends longitudinally and horizontally and thus parallel to the upper end edges of the carton side panels. At opposite ends of the two guide means on the track member are small abutments forming stop members for the slider. The slider has a generally tubular configuration with a longitudinal slot along one side which forms a pair of opposed jaws. These jaws fit within the guide means of the track member so that the slider can be moved from one end of the track member to its other end. When the track member is in place on a filled container, such as a milk carton, the slider is at rest at the channel end of the track member. The other end of the carton top can be opened in the normal manner, and when the carton is reclosed, the slider can be moved laterally on the track member to its other end to hold the carton panels firmly together.

Other objects, advantages and features of the present invention will become apparent from the following detailed description of one embodiment thereof, presented in conjunction with the accompanying drawing.

Brief Description of the Drawing

FIG. 1 is an exploded view in perspective showing a closure device for a milk carton according to the invention.

FIG. 4 is an enlarged view in section taken along the line 4—4 of FIG. 2.

FIG. 5 is an enlarged view in section similar to FIG. 4 showing an alternate form of closure according to the invention.

Detailed Description of Embodiment

Figure 2:
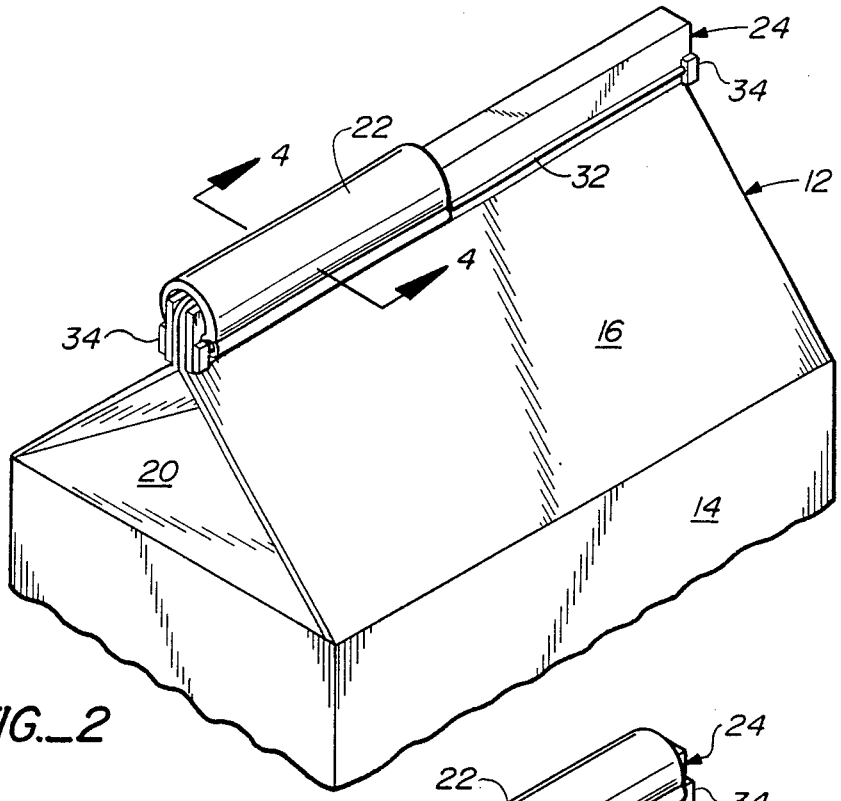
FIG. 2 is a view in perspective showing the closure device of FIG. 2 installed in the closed position.

With reference to the drawing, FIG. 1 shows a closure assembly 10 for a conventional foldable carton 12 of the type used for milk, juices and other liquids. The carton, made of a relatively thin cardboard material, has a typical construction including connected side panels 14 and end panels 12. The upper ends of the side panels are bent towards each other to form top panels 16 having edge flanges 18 that are engaged when the carton is closed. The upper ends of the end panels 12 form folded sections 20 that are adhered to the top panels 16 when the carton is closed. When the carton 12 is opened normally, one folded end section is separated from one-half of each top panel 16 and the edge flanges 18 are also separated along approximately one-half of the length of the upper edge flanges. (See FIG. 3.)

The closure assembly 10 is adapted to provide a liquid tight reclosure of the described carton 12 after it has been opened in the foregoing conventional manner. In general, the closure assembly comprises a movable slider 22 and a slider seat or track member 24.

The slider seat or track member 24 has a length approximately equivalent to that of the carton top edge flanges 18. Preferably, this slider seat is made of a relatively thin flexible plastic material such as polyethylene. As shown in FIG. 1, the slider seat has two parallel side members 26 which are spaced apart by a distance only slightly greater than the total thickness of the two top edge carton flanges. For approximately one half the total length of the slider member, the side members 26 are connected by an upper web portion 28. Thus, the other half of the slider member has a full slot 30 between the side members 26. As shown, the track or guide means 32 is located approximately three quarters of the way down from the top edges of the side members 26. Thus, being nearer the bottom edges, the track or guide means enables the movable slider 22 to provide a more effective gripping force on the carton top edge flanges 18.

Along the outside surface of each slider seat side member 26 is a longitudinally extending track or guide means 32 which extends parallel to its upper and lower edges. In the embodiment of FIGS. 1 and 4, the guide means is in the form of a slightly raised rib-like member 32 which is preferably integral with the side member 26. In an alternate form of the closure assembly 10, the guide means, as shown in FIG. 5, may be in the form of a pair of grooves 32A located in the side members 26.

At the opposite ends of each guide means 32 or 32A, a pair of small projections 34 are provided on the side members 26. These projections form stop members which prevent the movable slider 22 from being inadvertently disconnected from the slider member.

The slider 22 may be made of a suitable plastic or metal material and has a generally tubular shape with a longitudinal slot 36 along one side that forms a pair of opposed jaw portions 38 in cross-section. In the embodiment of FIG. 4, these jaw portions are provided with an enlarged edge portion having a longitudinal depression 40 which is large enough to receive the rib-like guide means 32 on each slider side member 26. In a somewhat modified form of slider 22, shown in FIG. 5, the jaw portions 38A have rounded edges 42 which fit within the grooves 32A that are provided within the outer surfaces of the slider side members 26.

When the closure assembly 10 is ready for installation on a carton, such as a standard milk carton, the slider 22 may be readily attached to its slider seat or track member 24 by merely flexing apart the slider jaw portions. When this is done, the jaw portions exert residual gripping force which causes the opposed parallel edges of the jaw portions to contact the guide means 32 on the slider side members 26 so that the slider 22 can be readily moved back and forth between the stop members 34.

The aforesaid installation of the slider 22 on its slider seat 24 can be made either before or after the seat 24 is placed on the adjoining top edge flanges 18 of the carton. Thus, the closure assembly 10 according to the invention can be provided either as a separate closure unit that is applied by a carton user after a full carton is purchased, or it can be installed on the carton at the location where the carton is initially filled and then closed before being sold at a market.

Figure 3:
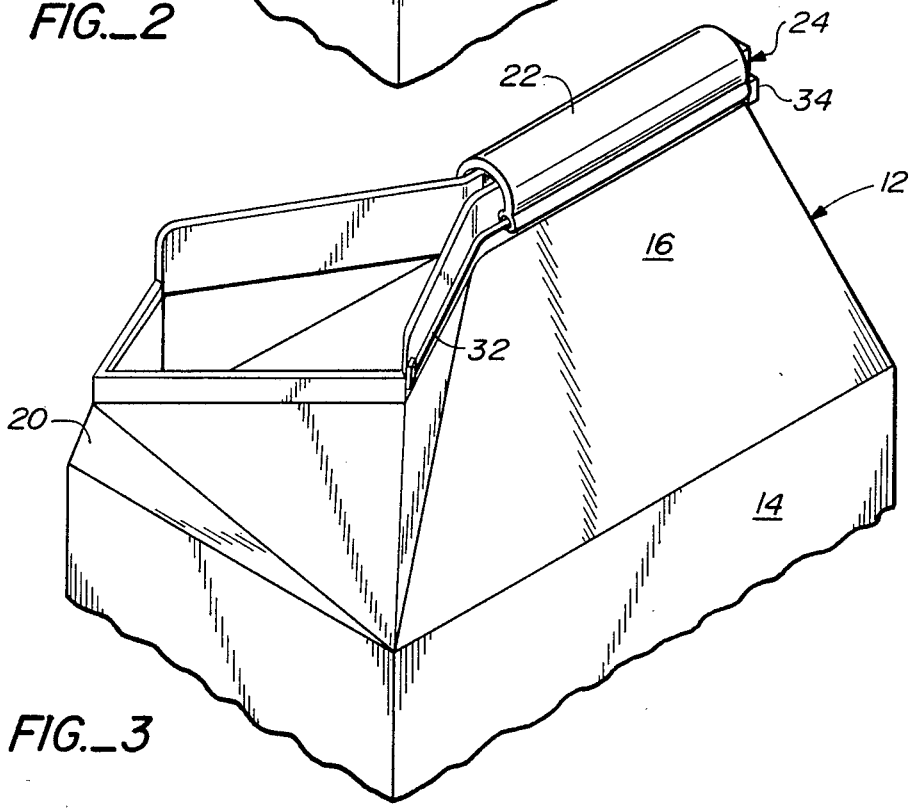
FIG. 3 is a view in perspective similar to FIG. 2 showing the closure device in the open position.

In operation, as shown in FIGS. 2 and 3, when the slider 22 and its slider seat 24 are attached to a carton, the slider is pushed to the extreme slotted end of the slider seat to hold the carton closed. In this position (FIG. 2) the slider will hold the carton closed to the same extent as if the carton had never been opened. Even violent movement or upside down positioning will not cause any leakage of liquid from the carton. When the carton is to be opened, as shown in FIG. 3, the slider 22 is moved easily along its guide means 32 to the other end of the slider seat 24 until it hits a stop member 32. In this position the slotted flanges 18 can be spread apart and the folded sections 20 can flex open in the normal manner to open the carton. With liquid still left in the carton, the slider can be quickly and easily moved to the other end of the slider seat or track member 24 to reclose the carton again.

To those skilled in the art to which this invention relates, many changes in construction and widely differing embodiments and applications of the invention will make themselves known without departing from the spirit and scope of the invention. The disclosure and the description herein are purely illustrative and are not intended to be in any sense limiting.

What is claimed is:

1. A reclosure device adapted for installation on a cardboard container having side walls and end walls connected to form a rectangle in cross-section, said side walls being held together along upper edges of the container and said end walls being held together along upper edges of the container and said end walls being folded between and attached to said side walls, said reclosure device comprising:

an elongated track member having spaced apart side portions adapted for attachment to said upper edges of said container side walls, said spaced apart side portions of said track member each having an outer surface with a guide means extending along said outer surface for substantially the full width of said carton side walls, said track member including a web portion interconnecting said side portions for approximately one half of its length;

an elongated slider member mounted on and parallel to said guide means, said slider member having opposed jaw portions along its length with edge means which are in contact with and slidable relative to said guide means; and stop means at opposite ends of said guide means for retaining said slider member on said track member.

2. The reclosure device as described in claim 1 wherein said guide means on said track member comprises an elongated rib member on each said side portion of said track member.

3. The reclosure device as described in claim 2 wherein said edge means on said jaw portions of said slider comprise an elongated enlarged portion having grooves which receive said rib members.

4. The reclosure device as described in claim 1 wherein said guide means on said track member comprises an elongated groove in the outer surface of each said side portion of said track member.

5. The reclosure device as described in claim 4 wherein said edge means on said jaw portions of said slider comprise rounded elongated edge surfaces which fit into said elongated grooves of said track side portions.

6. The reclosure device as described in claim 1 wherein said stop means comprise a pair of projecting members located at opposite ends of said guide means on each said track side portion.

* * * * *